US005771724A

United States Patent [19]

Hartung

[11] Patent Number: 5,771,724

[45] Date of Patent: Jun. 30, 1998

[54] METHOD AND APPARATUS FOR AN ANTICIPATORY THICKNESS CONTROL IN FOIL ROLLING

[75] Inventor: Hans-Georg Hartung, Pulheim, Germany

[73] Assignee: SMS Schloemann-Siemag Aktiengesellschaft, Dusseldorf, Germany

[21] Appl. No.: 625,730

[22] Filed: Mar. 29, 1996

[30] Foreign Application Priority Data

Mar. 30, 1995 [DE] Germany ..... 195 11 801.4

[51] Int. Cl.[6] ..... B21B 37/58

[52] U.S. Cl. ..... 72/11.8; 72/9.2; 72/14.7; 72/205; 72/365.2

[58] Field of Search ..... 72/205, 234, 365.2, 72/8.6, 9.2, 11.4, 11.8, 12.3, 12.8, 7.6, 14.7, 14.8, 15.5, 232

[56] References Cited

U.S. PATENT DOCUMENTS

| | | | |
|---|---|---|---|
| 4,548,063 | 10/1985 | Cox | 72/205 |
| 4,611,479 | 9/1986 | Guttinger | 72/241.6 |
| 4,809,527 | 3/1989 | Mitchell | 72/11.7 |
| 4,809,528 | 3/1989 | Lawson et al. | 72/205 |
| 4,964,289 | 10/1990 | Dean | 72/11.7 |
| 5,018,377 | 5/1991 | Lawson | 72/205 |
| 5,142,891 | 9/1992 | Kuwano | 72/205 |
| 5,535,610 | 7/1996 | Noe et al. | 72/205 |

FOREIGN PATENT DOCUMENTS

| | | | |
|---|---|---|---|
| 0050709 | 5/1981 | Japan | 72/205 |
| 58-41602 | 3/1983 | Japan | 72/205 |
| 58-17303 | 10/1983 | Japan | 72/205 |
| 1181912 | 7/1989 | Japan | 72/205 |
| 0639418 | 2/1994 | Japan | 72/205 |
| 0858955 | 8/1981 | U.S.S.R. | 72/205 |

*Primary Examiner*—Lowell A. Larson
*Assistant Examiner*—Ed Tolan
*Attorney, Agent, or Firm*—Friedrich Kueffner

[57] ABSTRACT

A method and an apparatus for an anticipatory thickness control in foil rolling by using characteristic lines stored in a process control computer of the individual manipulated variables (for example, strip tensions, rolling speeds) for various operating points (conditions of operation) or by using an on-line operating physical computing model, also in combination with a monitor control. The method includes the steps of determining the thickness deviations of the foil at the entry side of the roll stand and of compensating the thickness deviations by an anticipatory thickness control. The apparatus includes a thickness measuring device between the running-off reel and the rolling mill or the roll gap of the roll stand. The thickness measuring device is connected to a superordinated process control computer. Following the thickness measuring device is arranged a tensioning unit which serves to change the travel path of the foil strip between the running-off reel and the roll gap. For example, the tensioning unit elongates the travel path.

11 Claims, 3 Drawing Sheets

METHOD AND APPARATUS FOR AN ANTICIPATORY THICKNESS CONTROL IN FOIL ROLLING

BACKGROUND OF THE INVENTION

1. Field of the Invention

The present invention relates to a method and an apparatus for an anticipatory thickness control in foil rolling by means of characteristic lines stored in a process control computer of the individual manipulated variables (for example, strip tensions, rolling speeds) for various operating points (conditions of operation) or by means of an on-line operating physical computing model, also in combination with a monitor control.

2. Description of the Related Art

In contrast to strip rolling, in foil rolling it is no longer possible to control the thickness by means of a position control because such a position control is useless as a consequence of the extremely high strip modules. This also precludes the use of an anticipatory thickness control which is conventional in strip rolling and which is capable of changing the rolling force or the adjustment position of the rolls at the correct time as a foil portion having the incorrect thickness enters the roll stand, so that the foil exiting the roll stand remains as unchanged as possible. Because of the high strip modules of the foil, in foil rolling only a combined back tension and rolling speed control is used. The manner of operation of the tension and speed control is based on a change of the resistance to deformation of the foil, so that different thickness reductions of the foil can be adjusted while the rolling force remains constant.

SUMMARY OF THE INVENTION

Therefore, it is the primary object of the present invention to provide a method and an apparatus of the above-described type which make possible a faster and better compensation of the consequences of a thickness deviation of the foil entering the roll stand.

In accordance with the present invention, the above-described method includes the steps of determining the thickness deviations of the foil at the entry side of the roll stand and of compensating the thickness deviations by an anticipatory thickness control.

The present invention is based on the finding, obtained through practical experience as well as through theoretical experiments, that a thickness deviation of the foil at the entry side of the roll stand can also be determined at the exit side in a good approximation directly proportional to the reduction. Consequently, empirically obtained findings or findings determined by means of a physical/mathematical computing model concerning the consequences of a change of rolling parameters make possible the anticipatory thickness control for foil rolling in accordance with the present invention, i.e., a change in the rolling process at the correct time, so that a reaction to the measured thickness error is not carried out with delay by means of the monitor control, but is essentially avoided from the outset.

In accordance with a feature of the present invention, the rolling speed and/or the back tension or forward tension are changed. However, it is preferred to change the back tension of the foil by means of a highly dynamic tension means, preferably a highly dynamic running-off reel, in dependence on the operating point, while all other conditions remain the same. In analogy to the monitor control, the back tension represents the most effective manipulated variable for influencing the foil thickness. While it is advantageous, but not absolutely required, to know the characteristic lines for the classic foil thickness control, it is presupposed in accordance with the present invention that the influence of a variable change must be known exactly for the correct dimensioning of the step for the anticipatory control.

Accordingly, for the correct dimensioning of the anticipatory control step, the dependencies of the influences of an entry thickness change from the manipulated variable, preferably the back tension, are determined at various operating points and are stored in the process control computer for the thickness control. An operating point is defined by a certain combination of process parameters, for example, exit thickness, rolling speed, forward tension, roll diameter or lubrication.

The invention makes it possible to keep the necessary number of changes and the magnitude of the changes of the thickness control as small as possible, so that, consequently, the interruptions of the rolling process induced by the control itself can be decisively reduced. The characteristic lines of the individual manipulated variables for different operating points determined empirically or by means of a computing model are stored in the process control computer and that control line which is applicable for the actually prevailing condition of operation is obtained by interpolation from the bundle of characteristic lines stored in the process control computer for various operating points or conditions of operation. The difference quotient of the appropriate variable can then be determined from the characteristic line itself. Alternatively, the difference quotients can also be determined directly by means of an on-line operating physical model. These difference quotients indicate what back tension change or variable change must be carried out in order to achieve a certain thickness change of the foil exiting the roll stand, for example, to compensate for an exit thickness error of 1 $\mu$m. By multiplication with the exit thickness error to be expected as a result of an entry thickness change, it is then possible to obtain the change of the variable necessary for the error compensation.

Moreover, the anticipatory thickness control according to the present invention is capable of evaluating whether it is still possible or useful to carry out an anticipatory control step or a possibly necessary change in the thickness control by means of a certain variable. For example, if the difference quotient tends toward infinity, it can be concluded that the variable no longer has an influence and another variable must be utilized; in foil rolling, this is, for example, the exit tension or also the rolling force, however, the influence thereof is to be seen indirectly through a displacement of the operating point.

It is recommended to displace the desired value of the variable and the variable control window for returning the control means into a neutral position or to a neutral value.

An apparatus for carrying out the anticipatory thickness control method according to the present invention includes a thickness measuring device between the running-off reel and the rolling mill or the roll gap of the roll stand. The thickness measuring device is connected to a superordinated process control computer. Following the thickness measuring device is arranged a tensioning means which serves to change the travel path of the foil strip between the running-off reel and the roll gap. For example, the tensioning means elongates the travel path.

A tensioning means for changing the length of the travel path could be, for example, a loop-forming decelerating stand and/or pulling stand. Preferably however, a hydraulically adjustable control roll is proposed which advantageously is a force-controlled or position-controlled roll; for example, the control roll is the middle roll of a three-roll bridle. This control roll represents a highly dynamic tensioning means required for changing at the correct time the back tension of the strip; in the alternative, the running-off reel could be used as the tensioning means.

The force-controlled or position-controlled roll extending in front of the roll stand into the travel path of the foil to be rolled causes a change in the distance between the running-off reel or the coil of foil strip and the roll gap; in other words, the control roll produces an elastic change of the length of the foil strip and, consequently, a corresponding change in the tension of the strip in dependence on the operating point. The thickness measuring device arranged between the running-off reel and the roll gap for measuring the thickness of the foil may be of the commercially available type.

By changing the desired back tension value and taking along the back tension control window, the control roll can be returned into the neutral position. However, instead of utilizing the inertness of the reel for changing the back tension by means of a control roll, the method can also be carried out directly by means of a highly dynamic reel.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENT

Figure 1:
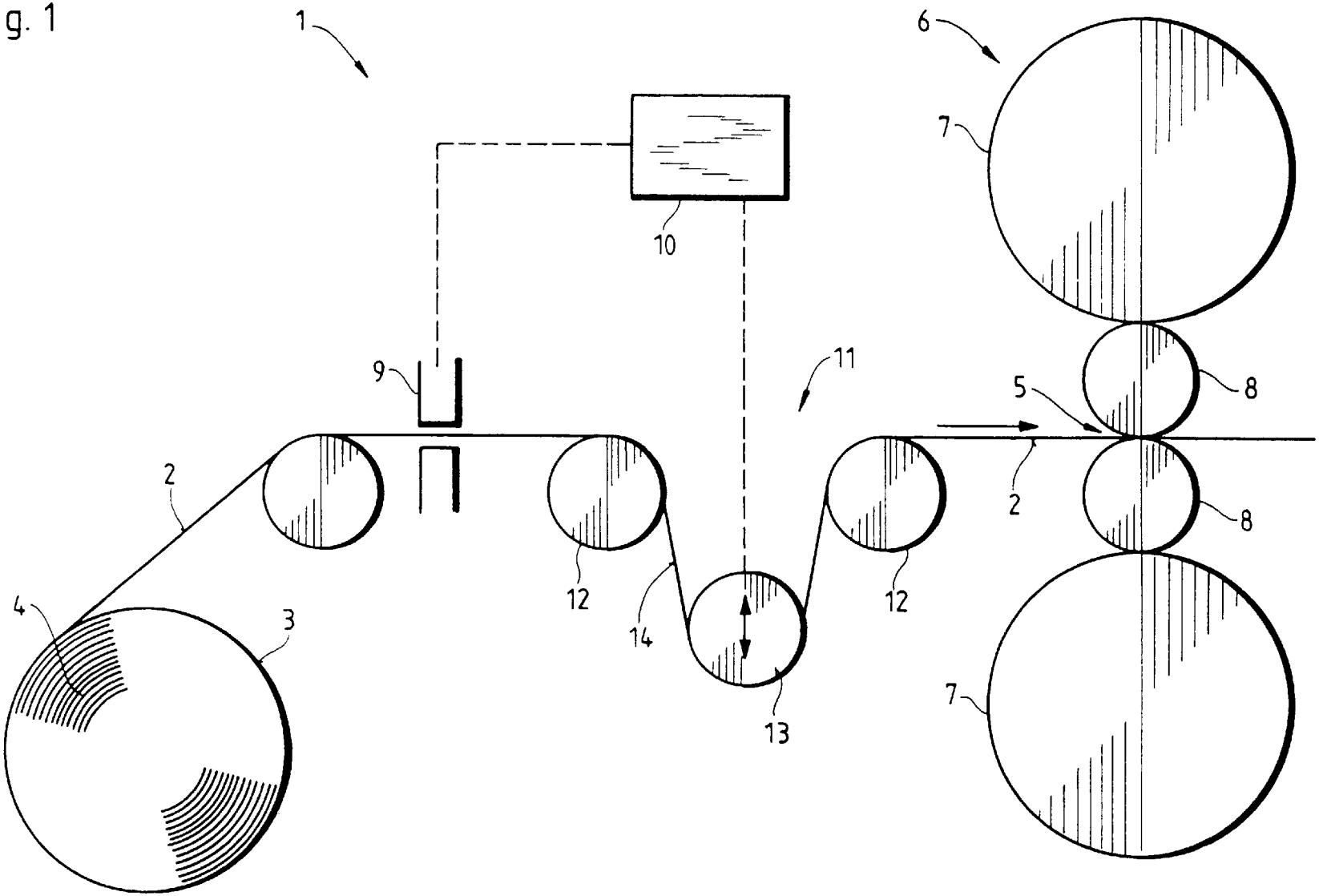
FIG. 1 is a schematic illustration of a plant for carrying out an anticipatory thickness control in foil rolling by means of a control roll.

FIG. 1 of the drawing is a schematic illustration of a plant 1 for rolling a foil or a foil strip 2. The foil strip 2 is pulled from a coil 3 on a running-off reel 4 and is transported to the roll gap 5 of a roll stand 6 which is not illustrated in detail and is arranged downstream of the running-off reel 4. The roll stand 6 includes upper and lower back-up rolls 7 and corresponding work rolls 8.

A conventional thickness measuring device 9 is arranged between the running-off reel 4 and the rolling mill or roll stand 6. The thickness measuring device 9 is electrically connected to a superordinated process control computer 10. Between the thickness measuring device 9 and the roll stand 6 is arranged a tensioning means 11 in the form of a three-roll bridle composed of three rolls 12 and 13. The middle roll 13 is constructed as a force-controlled or position-controlled, hydraulically adjustable control roll which is also electrically connected to the process control computer 10. As shown in FIG. 1, the middle roll 13 may be moved into the travel path of the foil strip 2 and is capable of changing the back tension by changing the strip loop 14.

For carrying out an anticipatory thickness control of the foil strip 2 before it enters the roll stand 6, characteristic lines of the individual manipulated variables for various operating points determined by means of a computing model or empirically have been stored in the process control computer 10 or the effect of the variables is computed on-line.

Figure 2:
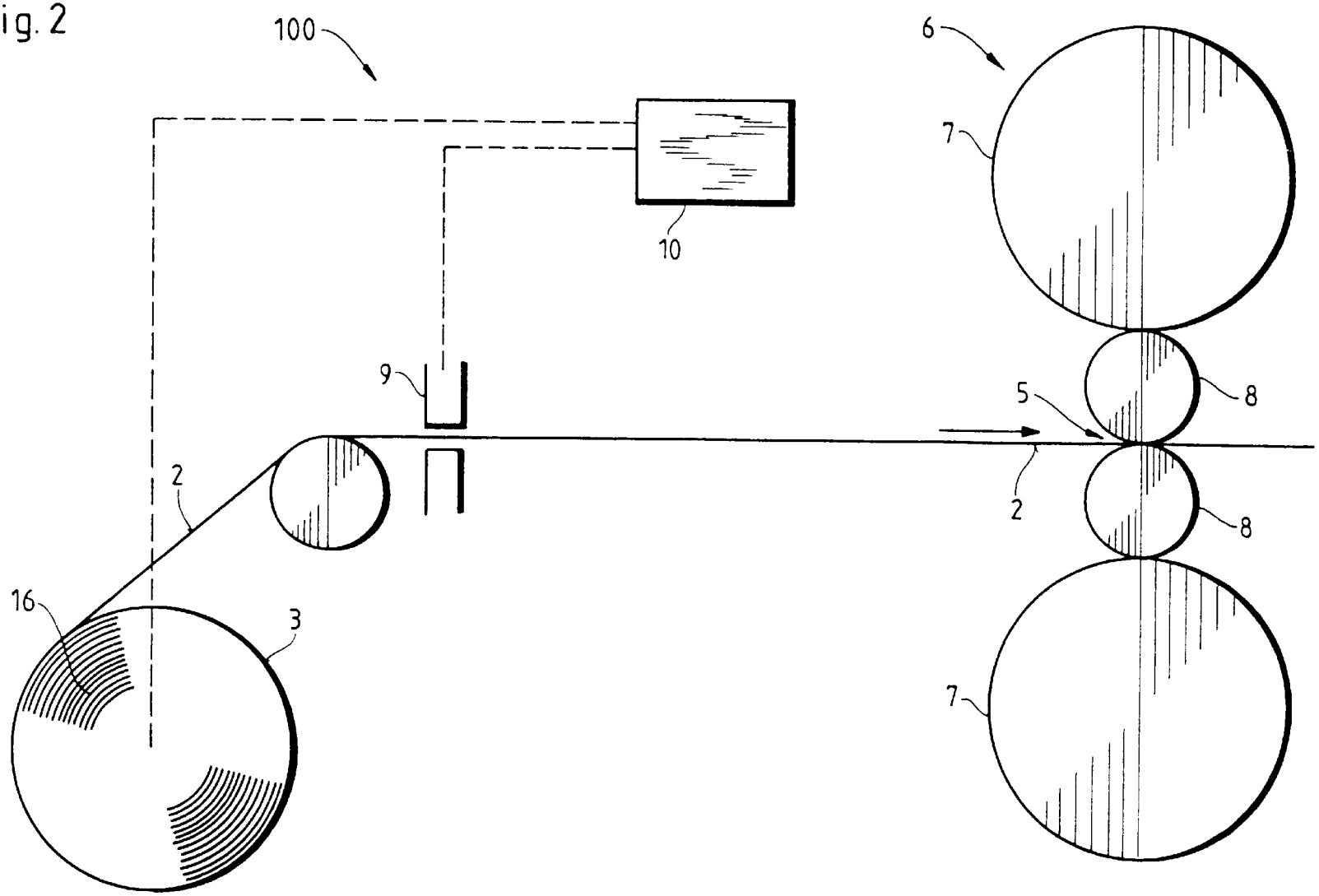
FIG. 2 is a schematic illustration of a plant for carrying out in anticipatory thickness control in foil rolling by means of a highly dynamic reel.

FIG. 2 of the drawing shows another embodiment of a plant 100 for rolling a foil or a foil strip 2. The plant 100 is essentially the same as plant 1 shown in FIG. 1, with the exception that the quick back tension changes necessary for the anticipatory thickness control are not carried out by means of a tensioning means arranged between the thickness measuring device 9 and the roll stand, but the changes are carried out directly by means of a highly dynamic reel 16.

Figure 3:
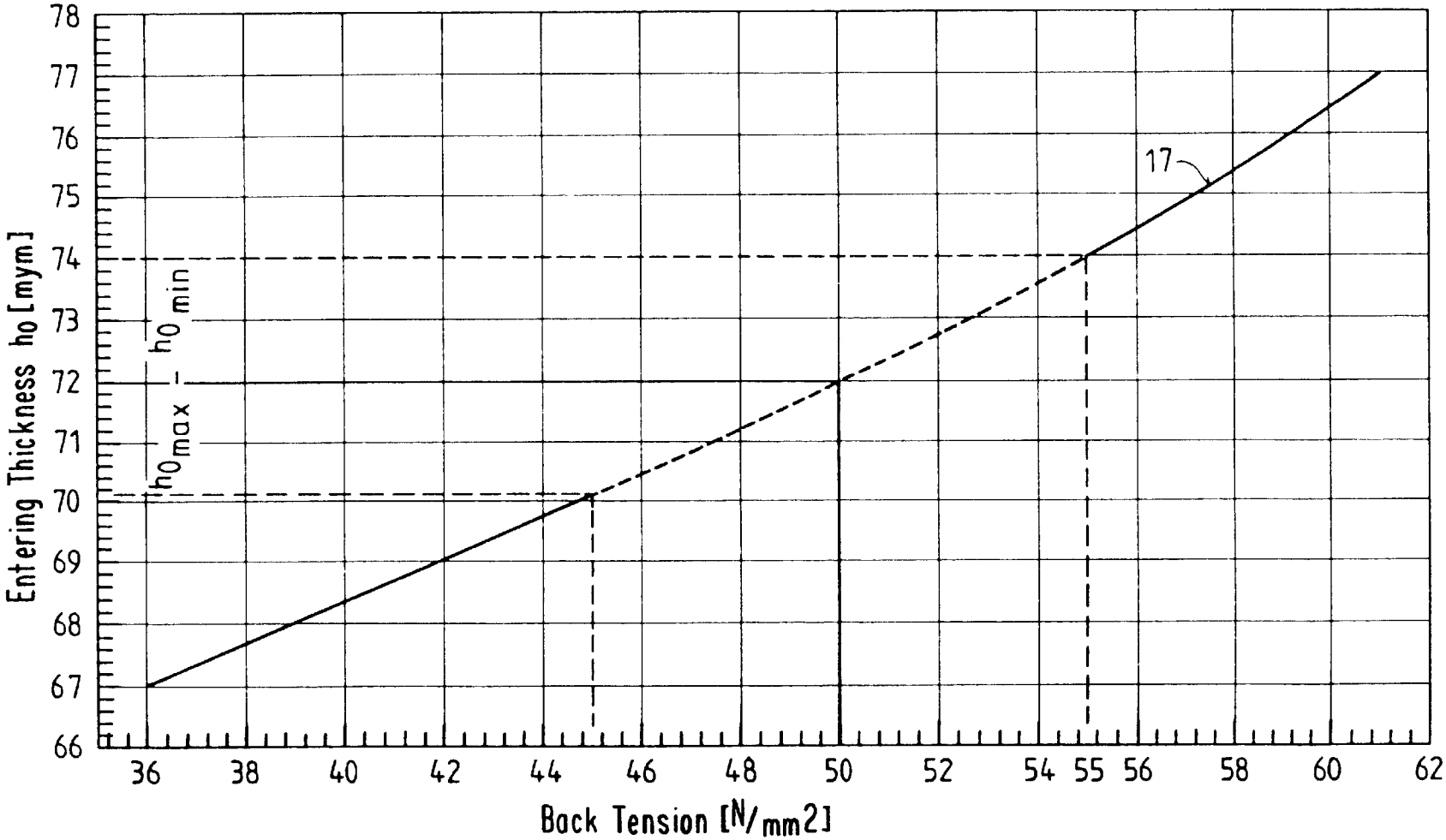
FIG. 3 is a diagram with a theoretically determined characteristic line for the compensation of a thickness change of the entering foil by carrying out at the correct time a change of the back tension.

The diagram of FIG. 3 shows an example of an anticipatory thickness control in the plant 1 of FIG. 1 or the plant 100 of the FIG. 2 in which a suitable change in the back tension is used to compensate for a thickness change of the entering foil, while the exiting foil thickness (33 mym) the rolling force (6000 kN) and the rolling speed are constant. In order to be able to be able to explain the subsequently described compensation of the thickness change of the entering foil strip 2, it is assumed that the entering foil strip 2 has a thickness change of 72 $\mu$m −74 $\mu$m.

This thickness change of the entering foil strip 2 and the valid characteristic line of the defined operating point, which is obtained by interpolation from a multitude of characteristic lines stored in the process control computer 10 or directly by means of a physical process model, make it possible to compensate the thickness change by increasing at the correct time the back tension from 50 N/mm$^2$ to 55 N/mm$^2$; the control range selected as an example is represented by the broken portion of the characteristic line 17 in FIG. 3.

For increasing the back tension to 55 N/mm$^2$, in the example of FIG. 1, the control roll 13 of the tensioning means 11 is lowered into the travel path of the foil 2, so that an elastic change in the length of the foil strip 2 is produced. This is carried out at the correct time, i.e., with high dynamics of the tension change, which is made possible by the adjustable control roll 13, i.e., by the control roll 13 which can be raised and lowered. Consequently, by measuring the thickness of the entering foil strip by means of the thickness measuring device 9 arranged between the running-off reel 4 and the roll gap 5 or the roll stand 6, a tension change can be achieved which is additive and which is dimensioned with the aid of the characteristic line and the thickness error of the entering strip, so that the control described above eliminates or substantially reduces any thickness error already at the outset.

While specific embodiments of the invention have been shown and described in detail to illustrate the inventive principles, it will be understood that the invention may be embodied otherwise without departing from such principles.

I claim:

1. A method for controlling a foil thickness in foil rolling in a roll stand by utilizing characteristic lines of individual manipulated variables for various operating points stored in a process control computer, also in combination with a monitor, the method comprising determining thickness changes of the foil on an entry side of the roll stand, and carrying out an anticipatory thickness control for compensating the thickness changes by changing a desired back tension value.

2. The method according to claim 1, comprising changing a selected variable by utilizing a highly dynamic control means in dependence on an operating point, while maintaining all other rolling parameters.

3. The method according to claim 2, wherein the selected variable is a strip tension.

4. The method according to claim 2, comprising shifting a desired value of the selected variable and a variable control window for returning the control means into a neutral position or into a neutral value.

5. The method according to claim 1, comprising changing the back tension of the foil in dependence on an operating point by using a highly dynamic running-off reel.

6. An apparatus for carrying out an anticipatory thickness control of a foil traveling from a running-off reel to a rolling mill, the apparatus comprising a thickness measuring device arranged between the running-off reel and the rolling mill and connected to a superodinate process control computer, and tensioning means for the foil arranged downstream of the thickness measuring device for changing a desired back tension value of the foil between the running-off reel and the rolling mill.

7. The apparatus according to claim 6, wherein the tensioning means comprises a control roll.

8. The apparatus according to claim 7, wherein the control roll is force-controlled.

9. The apparatus according to claim 7, wherein the control roll is position-controlled.

10. The apparatus according to claim 7, wherein the control roll is constructed so as to be hydraulically adjustable.

11. The apparatus according to claim 6, wherein the running-off reel is a highly dynamic running-off reel, the running-off reel being the tensioning means.

* * * * *